United States Patent [19]

Beck et al.

[11] Patent Number: 4,718,602

[45] Date of Patent: Jan. 12, 1988

[54] FUEL OPERATED VEHICLE HEATER

[75] Inventors: Wolfgang Beck, Munich; Werner Lucius, Starnberg; Ernst Mosig, Iffeldorf; Bernhard Umlauf, Seefeld, all of Fed. Rep. of Germany

[73] Assignee: Webasto-Werk W. Baier GmbH & Co., Gauting, Fed. Rep. of Germany

[21] Appl. No.: 912,529

[22] Filed: Sep. 29, 1986

[30] Foreign Application Priority Data

Oct. 10, 1985 [DE] Fed. Rep. of Germany ..... 3626143
Oct. 10, 1985 [DE] Fed. Rep. of Germany ..... 3536170

[51] Int. Cl.[4] ..... B60H 1/22

[52] U.S. Cl. ..... 237/32; 126/110 B; 126/110 D; 237/12.3 C

[58] Field of Search ..... 237/12.3 C, 12.3 A, 237/12.3 R, 2 A, 32; 126/110 B, 110 C, 110 D; 432/222, 223, 224

[56] References Cited

U.S. PATENT DOCUMENTS 4,201,544 5/1980 Briggs et al. ..... 432/222

OTHER PUBLICATIONS

Webasto Brochure, "Outside Its Cold, Inside Its Webasto".

*Primary Examiner*—Henry A. Bennet
*Attorney, Agent, or Firm*—Sixbey, Friedman & Leedom

[57] ABSTRACT

A fuel-operated vehicle heater especially of the type intended as an auxiliary or additional vehicle heater and which has a nozzle sitting on a nozzle holder to which fuel is fed from a fuel line by a filter, a fuel pump and an interposed solenoid valve. In a preferred embodiment heater, the nozzle holder, fuel pump, filter and solenoid valve form a subassembly that can be handled as a single unit. Advantageously, this subassembly can be fastened by screws to a flange within a housing part of the heater. On this flange can also be fastened an ignition spark emitter an a central connecting device, such as a burner motor. Advantageously, the feed line and/or the return line for the fuel supply are formed in the flange.

19 Claims, 5 Drawing Figures

FUEL OPERATED VEHICLE HEATER

BACKGROUND AND SUMMARY OF THE INVENTION

The invention relates to a fuel-operated vehicle heater, especially an auxiliary heater.

Such a heater generally has a nozzle, sitting on a nozzle holder, to which fuel is fed from a fuel line, via a filter, a fuel pump and a solenoid valve. A fuel mixture is produced in the area of the nozzle outlet from the fuel and combustion air which is delivered by a combustion air blower driven by a drive motor. To ignite this mixture, an ignition spark emitter is placed so that free ends of its ignition electrodes are directed into proximity with the nozzle outlet. Optionally, the nozzle holder carries a preheater and is supported by a flange on the housing of the heater.

In the case of heaters of this type (for example, the Type DBW 2010 heater produced by the assignee of the present application), up to now the components, such as the nozzle holder with the nozzle, the fuel pump, filter, solenoid valve and ignition spark emitter were assembled separately in the heater with the necessary connections.

As a result, not only is assembly of such a heater time-consuming but connection mistakes can occur by confusion. Further, in the case of present heaters, the functioning units necessary for the burner occupy a relatively large amount of space, so that the heater, as a whole has rather large installation dimensions.

Therefore, a primary object of the invention is to overcome the difficulties described above and to achieve a fuel-operated heater of the noted type which is as compact as possible and enables a substantially simplified assembly of the heater to be obtained. Also, it is a further object to enable the power consumption of the units needed for operation of the heater to be reduced as much as possible.

According to a preferred embodiment, especially the nozzle holder, fuel pump, filter and solenoid valve are combined in a single subassembly, which may be handled as a unit. This subassembly is designed to be extremely compact and forms the central operating unit of the burner of such a fuel-operated heater. Assembly of the heater is substantially simplified by the fact that, in this subassembly, several functional parts are combined and, thus, only the subassembly needs to be attached at predetermined places, for example, with the aid of screws.

Furthermore, it has been shown, in a surprising way, that by this compact type of construction of the heater in connection with the arrangement of the parts necessary for functioning, the heater can operate with less noise than before, and, also, a reduction of the power consumption is attained.

In an advantageous further development of the invention, the filter is joined with the fuel pump, so that the filter forms a combined functional and support subassembly with the fuel pump. As a result, a further considerable saving of space is achieved. Further, in the combustion operation, because of its closeness to the combustion chamber, the filter is heated to the extent that paraffin precipitation is avoided in the case of cold fuel.

Preferably, the ignition spark emitter with integrated electrodes can be fastened onto the above indicated subassembly formed according to the invention, so that no particular cables are needed for the ignition spark emitter, as a result of which assembly is made easier and a change of polarity is no longer possible. Further, because of the absence of the cables, especially for the ignition electrodes, the degree of supression of the ignition noise (HF region) can be considerably improved.

Advantageously, the subassembly is fastened to a flange of the heater housing, for which screws or the like can be provided, and the flange with the subassembly fastened thereto is then placed in a receiving space of the heater in a predetermined way.

According to another advantageous feature according to the invention, the housing flange is used not only for holding and supporting the subassembly but also the feed line and return line running to the fuel pump are designed in the flange and are formed, for example, by bores going through the flange. Thus, separate fuel lines running to and from the fuel pump (as have been customary) can be eliminated and the intrinsic safety of the heater improved. In this way, also, the assembly operation is made easier. Further, in a constructively very simply way, a connection can be established from the feed line and return line in the flange to the fuel pump intake and/or output with the help of a seal. The seal, on the one hand, works with the corresponding connecting parts of the pump housing and, on the other hand, with the corresponding countersurfaces on the flange. Since the flange easily is heated during the combustion operation, the fuel is preheated, particularly in the feed line, and better combustion is attained.

For supplying electric power to the parts of the subassembly, advantageously, a central connecting device is provided with a control device or connecting device. This device is fastened to the side of the flange which faces away from the nozzle. In this way, additional electric connecting lines can be eliminated and the central connecting device largely replaces a cable assembly that has been the usual means for providing electrical power up to now. Since, in this way, mixing up of cables and the resulting connecting mistakes are avoided, yet another significant simplification of the assembly and a high operating reliability of the heater is attained.

To use the space around the nozzle holder and nozzle as much as possible, the fuel pump with the attached filter, the solenoid valve and the ignition spark emitter are placed radially around the nozzle holder, so that the smallest possible dimensions for the burner as a whole are attained.

Preferably, the fuel pump and the combustion air blower delivering the combustion air are driven directly, for which purpose the drive motor is fastened to the side of the flange that faces away from the nozzle. By having the fuel pump and combustion air blower directly driven, power losses on the drive side are reduced and, especially, the design of the drive side of such a heater is simplified.

The heater according to the invention is also so constituted that, for different power ranges of the heater, only the nozzle and drive motor have to be exchanged. All other parts can be kept unchanged for different heating power ranges, so that, in regard to warehousing, a smaller inventory expenditure is required than heretofore has been necessary. Thus, the heater according to the invention also can be favorably adjusted to different heating ranges from a production engineering standpoint in an economical way.

Advantageously, a preheater in the form of a heating cartridge is also integrated into the subassembly. To this end, the nozzle holder can be provided with a projection, which has a through-hole, into which the preheater cartridge may be plugged. Preferably, the preheater is placed close to the filter so that, during operation of the preheater, the filter is also heated to prevent paraffin precipitation on the filter at low temperatures.

Preferably, an O-ring seal is provided for sealing of the connection between the fuel pump of the subassembly and the mounting flange of the heater housing so that, as a result of the design of the fuel supply in the flange, there are few places requiring sealing. In this way, the operating safety of such a heater is increased.

Further, the design according to the invention is also such that the solenoid valve is in the immediate proximity of the atomizing nozzle, so that there is a extremely short fuel path between the solenoid valve and the atomizing nozzle. Thus, with closing of the solenoid valve, a continued dripping of fuel from the atomizing nozzle is largely prevented.

Additionally, the burner according to the invention has the pump and, especially, the filter facing toward the combustion space of the heater. Therefore, a more favorable operating behavior results, particularly at low temperatures, since these parts are heated during combustion operation and thereby clogging of the filter, for example, by paraffin precipitation, is prevented.

Still a further aspect of the invention lies in the subassembly, made of the nozzle holder, fuel pump, filter and solenoid valve as well as optionally also the preheater, also holding a flame monitor. For this purpose, a socket opening is formed in the subassembly in which a phototransistor can be plugged in as flame monitor.

In the atomizing burner according to the invention, therefore, the subassembly unit which holds and contains all the essential components necessary for the functioning of a burner.

For an energy-saving operation of the preheater, such as the heating cartridge, the preheater is not always switched on for the same amount of time, but rather the switch-on period is varied, namely, it is shorter the higher the temperature of the heater. Advantageously, the time variation takes place in steps as a function of predetermined temperature threshold values. By means of a timing circuit between a temperature sensor, such as a water temperature sensor in the case of a water heater, and the preheater, the preheater switch-on period can be so varied that, as a function of the temperature threshold values, in each case it changes an integral multiple of a minimum switch-on period of about one minute. Since, hereby, in comparison with a constant specified switch-on period of the preheater, the power consumption can be considerably reduced, the preheater consumes less energy for operation than up to now, and the preheater can even be cut off if the temperature condition of the heater makes preheating unnecessary.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
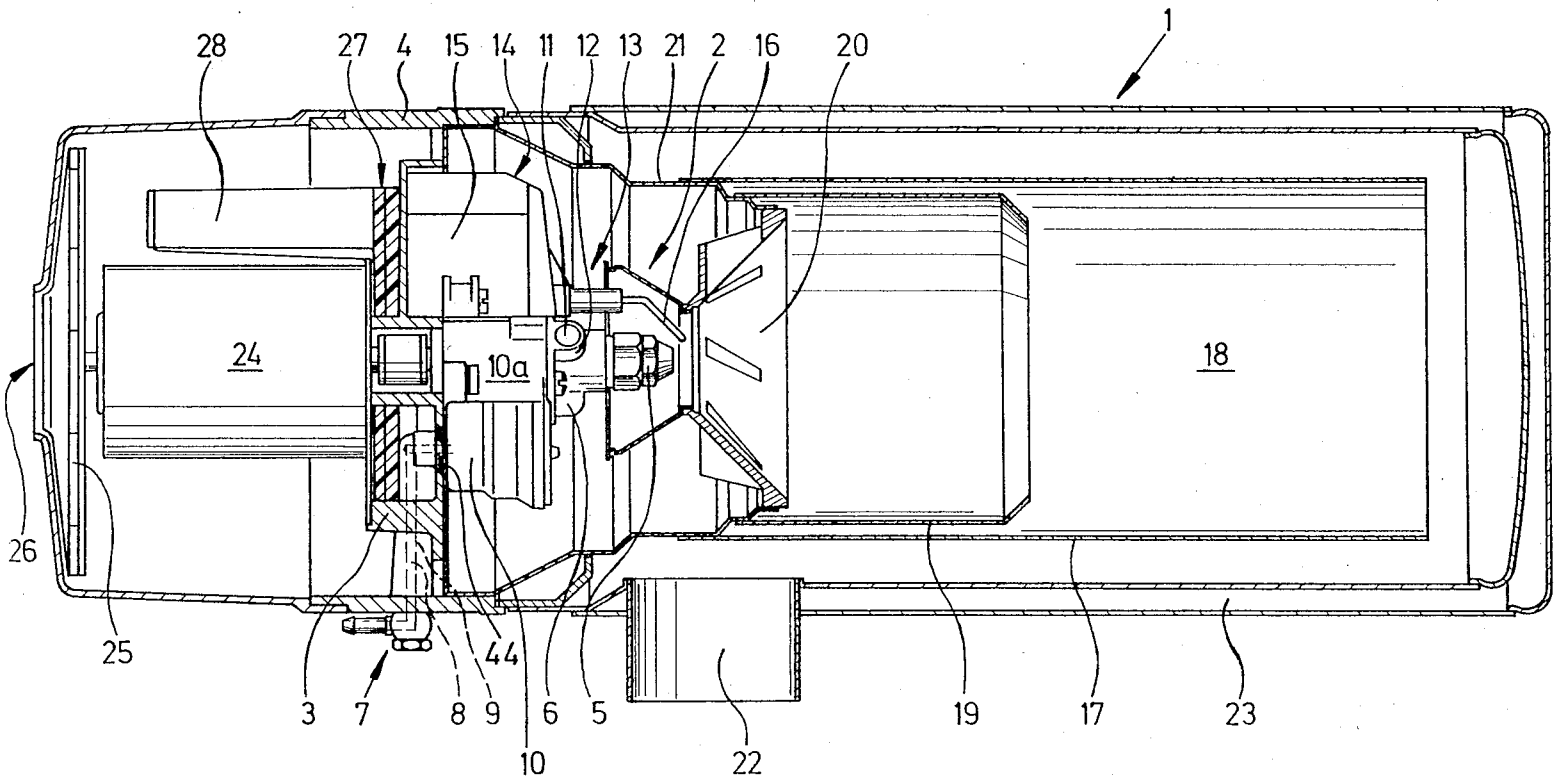
FIG. 1 is a sectional view through a heater.
Figure 3:
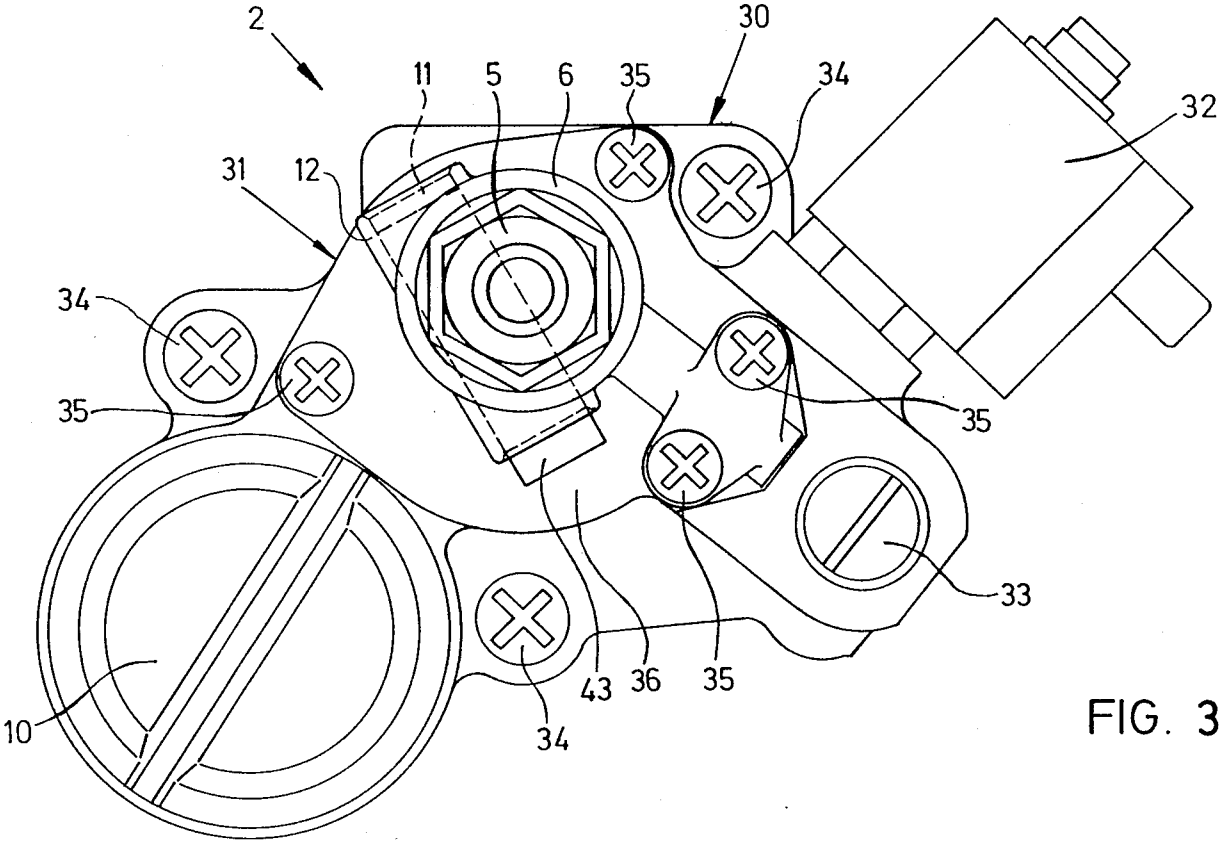
FIG. 3 is a top view of the subassembly of the heater.

FIG. 1 diagrammatically represents a heater identified as a whole by reference numeral 1, which exhibits an atomizing burner identified as a whole as 2. Atomizing burner 2 is fastened to a flange 3, which is formed on a housing 4. As represented, atomizing burner 2 has an atomizing nozzle 5, which is carried by a nozzle holder 6. For supplying fuel to atomizing nozzle 5, a fuel connection 7 with a feed line 8 and return line 9 (represented in broken lines) is formed in flange 3 of housing part 4. Feed line 8 opens into a filter 10 which, in FIG. 1, is installed upstream from fuel pump 10*a*. The fuel is delivered from pump 10*a* to atomizing nozzle 5 via an interposed solenoid valve 32. In the case of the embodiment represented, atomizing nozzle 5 with nozzle holder 6, the fuel pump 10*a*, the filter 10 and solenoid valve 32 form a subassembly, which is fastened to flange 3. Further, a through-hole 11 can be noted (FIG. 1) in a projection 12 formed on nozzle holder 6. Through-hole 11 is used to receive a nozzle holder preheater 43, preferably a heating cartridge as represented in FIG. 3.

Additionally, atomizing burner 2 is provided with an ignition device, identified as a whole by 13, which is formed by an ignition spark emitter 14, whose housing is identified by 15. Preferably, two ignition electrodes 16 (of which only one can be seen in FIG. 1) are fastened on housing 15 by means of a plug connection, or they can be fixed integrated therewith.

Atomizing burner 2 projects into a combustion chamber 18 formed by a burner tube 17, a chamber in which an insert 19 is placed for flame support. In the axial direction of atomizing nozzle 5 at a distance from it is placed a twist body 20, which is supported by a holder 21 in the housing of heater 1.

The combustion gases exit the combustion chamber 18 and, after a reversal of direction at the end of burner tube 17 opposite atomizing burner 2, flow to an exhaust gas outlet 22. Burner tube 17 is surrounded by a double jacket heat exchanger arrangement, in whose annular space 23 a heat transfer medium, such as water, circulates. The heat transfer medium enters by an intake, not represented, and is discharged by an outlet also is not represented. This heat transfer medium is heated by the combustion gases as it passes through annular space 23 countercurrent to flow through the exhaust system, in the switched on condition of heater 1.

As can also be seen from FIG. 1, a burner motor 24 is fastened on flange 3 on the side opposite atomizing nozzle 5. Motor 24 drives a combustion air blower 25 and fuel pump 10a at the same time. The combustion air flows in at intake 26 and, with the help of combustion air blower 25, is delivered to the mixture preparation zone at atomizing nozzle 5.

Between burner motor 24 and the rear side of the flange 3 (i.e., the side that faces away from the atomizing nozzle 5) is provided a connection device identified as a whole as 27. Connection device 27 serves as the means by which power is supplied to all of the devices of the heater, such as burner motor 24, ignition spark emitter 14, a flame monitoring device 29, a nozzle holder preheater 43, etc. A control device 28, which preferably is connected to connection device 27 by a plug connection, also works with this connection device 27.

Figure 2:
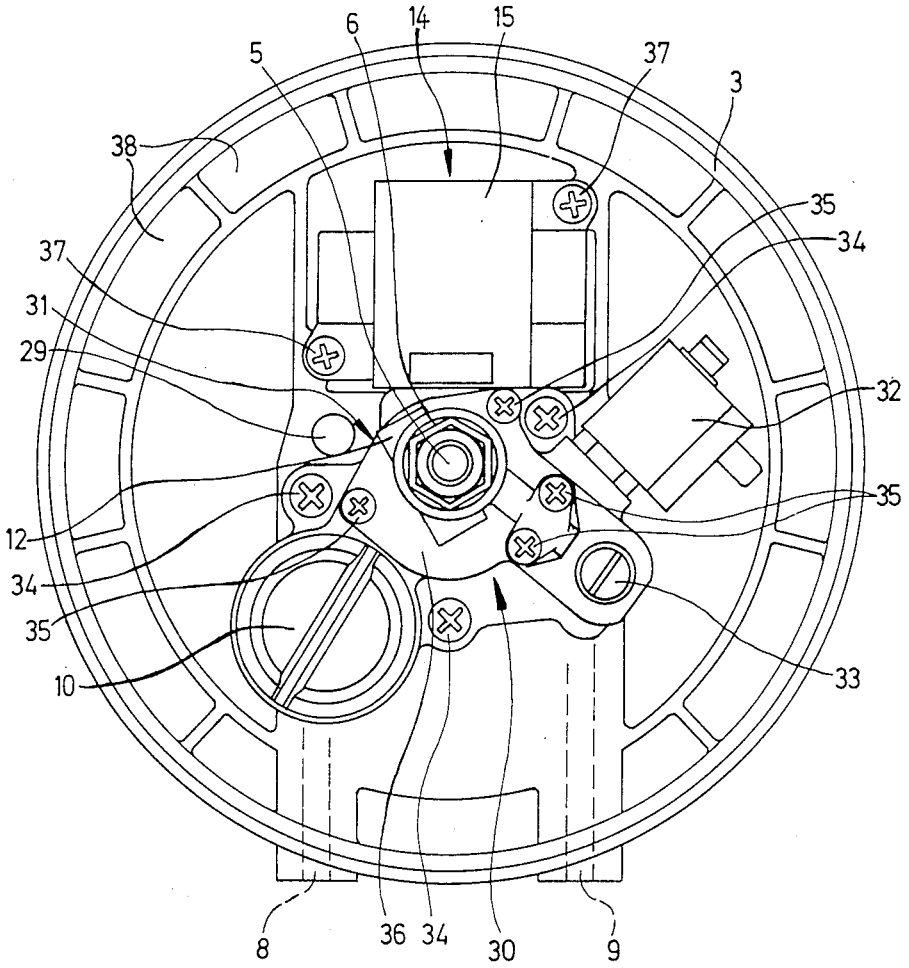
FIG. 2 is a top view of the burner device of the heater in diagrammatic representation.

In FIG. 2, which shows a top view of flange 3 with atomizing burner 2 and the corresponding units, the same or similar parts as in FIG. 1 are provided with the same reference numbers. For reasons of clarity, the twist (vorticization element) body 20 in FIG. 1 is not shown in FIG. 2, to illustrate the arrangement of nozzle holder 6 with atomizing nozzle 5 and a subassembly, identified as a whole as 30, which is formed by nozzle holder 6, the fuel pump, of which only housing 31 is to be seen in FIG. 2, filter 10 and a solenoid valve identified as 32. As can be seen in FIG. 2, a pressure adjusting screw 33 is placed upstream of solenoid valve 32 in the direction of fuel flow through sub-assembly 30 (see FIG. 4), by means of which the pressure for the fuel supply of atomizing nozzle 5 can be adjusted by rotation of this adjusting screw.

Also in FIG. 2, feed line 8 and return line 9 of the fuel supply are drawn in broken lines. These fuel lines are designed as through-holes in flange 3.

Screws 34 (FIG. 2) are provided as the means by which subassembly 30 is fastened to flange 3 and screws 35 serve for fastening of a cover 36 to sub-assembly 30 over nozzle holder 6 of housing 31 of the fuel pump. Housing 15 of ignition spark emitter 14 is fastened to flange 3 with the help of screws 37, after ignition spark emitter 14 has been directly connected to central connection device 27, for example, directly by a plug connection.

Air passage openings 38 are circumferentially distributed along the periphery of flange 3 and form ducts through which the combustion air travels axially. As can be seen further from FIG. 2, in a space saving arrangement, filter 10, pressure adjusting screw 33, solenoid valve 32, which with nozzle holder 6 form subassembly 30, and ignition spark emitter 14 are placed radially around atomizing nozzle 5, so that a very compact construction of the units necessary for functioning of an atomizing burner 2 is obtained.

During assembly of the heater, preassembled subassembly 30 is screwed onto flange 3 by screws 34 and cover 36 is fastened to the nozzle holder via the screws 35. Then ignition spark emitter 14, which is shown in FIG. 2, can also be fastened onto flange 3 with the help of screws 37.

Thus the above indicated units, after fastening to flange 3, form with it a unitary manageable part which is then inserted into housing part 4 and is suitably fastened there. From the above explanation, it can be seen that the parts of atomizing burner 2 necessary for functioning can be fastened to flange 3 quickly. Central connection device 27, shown in FIG. 1, is then fastened to the rear side of flange 3 (that facing away from atomizing nozzle 5), and then burner motor 24 is plugged in and also, as can be seen in FIG. 1, fastened to flange 3. Thus, flange 3 carries all the parts necessary for functioning of atomizing burner 2 of heater 1.

Of course, subassembly 30 and ignition spark emitter 14 can also be placed on flange 3 in a way deviating from the example represented, and also the manner of fastening can be chosen in a way that deviates herefrom. For example, more or fewer screws than represented can be used for fastening the parts to flange 3 and they can be arranged in a different way. Further the relative position of the units of subassembly 30 and the other parts can vary in relation to one another.

Figure 4:
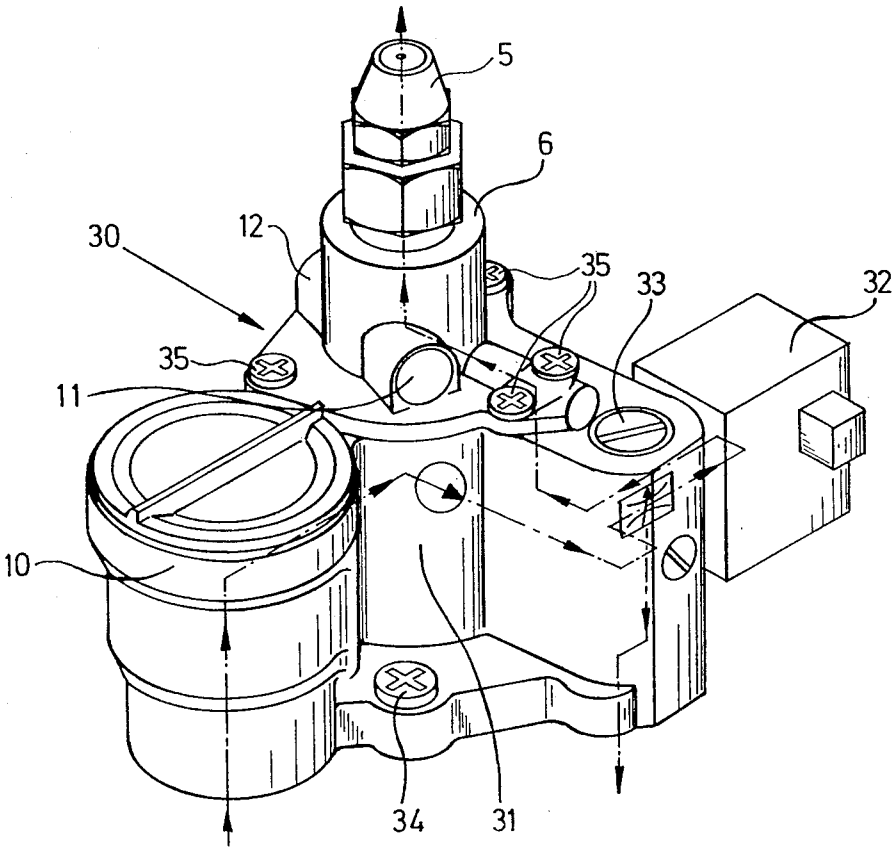
FIG. 4 is a perspective view of the subassembly according to FIG. 3 for illustrating the fuel supply.

In FIG. 3 subassembly 30 is represented by itself and shown in top view, while a perspective view is provided thereof in FIG. 4. In this subassembly 30 are included nozzle holder 6 with atomizing nozzle 5 connected to the fuel pump (of which only housing 31 is visible in FIG. 3), filter 10 and a solenoid valve 32. Also in FIG. 3, a pressure adjusting screw 33 can be seen, by means of which the fuel pressure can be adjusted. Pressure adjusting screw 33 is installed upstream in the direction of the fuel inflow to atomizing nozzle 5 and solenoid valve 32. This subassembly 30 can be fastened on flange 3 shown in FIG. 1 with the help of screws 34. Cover 36 contains nozzle holder 6 with atomizing nozzle 5 and projection 12 with through-hole 11 for plugging in of nozzle holder preheater 43. Cover 36 as so designed is fastened by screws 35 to the base of subassembly 30.

As shown, nozzle holder preheater 43 is placed close to filter 10 to succeed in heating filter 10 and the fuel located therein, to avoid paraffin precipitation before reaching atomizing nozzle 5.

A seal 44, preferably designed as an O ring seal, is provided between feed line 8 (which is formed in flange 3, as seen in FIG. 1) and the intake of filter 10.

Solenoid valve 32 is placed in the immediate vicinity of atomizing nozzle 5 and the latter is installed directly upstream thereof in the fuel flow direction. Therefore, if solenoid valve 32 blocks the fuel flow, a subsequent flow of the fuel to atomizing nozzle 5 can be prevented, since solenoid valve 32 is placed close to the fuel intake of the atomizing nozzle 5.

Although not represented in detail, subassembly 30 can, optionally, receive a flame-monitoring device 29 (FIG. 2) for which an opening is provided in the base of subassembly 30, into which it is introduced in the form of a phototransistor.

FIG. 4, illustrates in greater detail the spatial relationship of the functioning parts of subassembly 30. Identical or similar parts are also provided with the same reference numbers in FIG. 4 as in FIGS. 1 and 3. In addition, the fuel flow of subassembly 30 through filter 10, fuel pump 31, pressure adjusting screw 33, solenoid valve 32 to atomizing nozzle 5 is also shown in FIG. 4. The fuel return flow from the atomizing nozzle is indicated in broken lines. As can be seen from both fuel flow paths, the fuel is fed over the shortest path possible, going from filter 10 to atomizing nozzle 5 to improve the operational behavior of such an atomizing burner 2. In addition to easier assembly and the space-saving arrangement of subassembly 30, such a construction of an atomizing burner 2 according to the invention makes it possible for the disturbances caused by the fuel to be reduced as much as possible. Since subassembly 30 as a whole projects into combustion chamber 18 shown in FIG. 1, subassembly 30 as a whole is heated during operation of the burner and also cold start difficulties can be avoided.

However, to assure a reliable operation of heater 1 especially in case of cold starting heater 1, in the embodiment represented in FIGS. 1, 3 and 4, subassembly 30 has a nozzle holder preheater 43 which preferably is formed by a heating cartridge.

Figure 5:
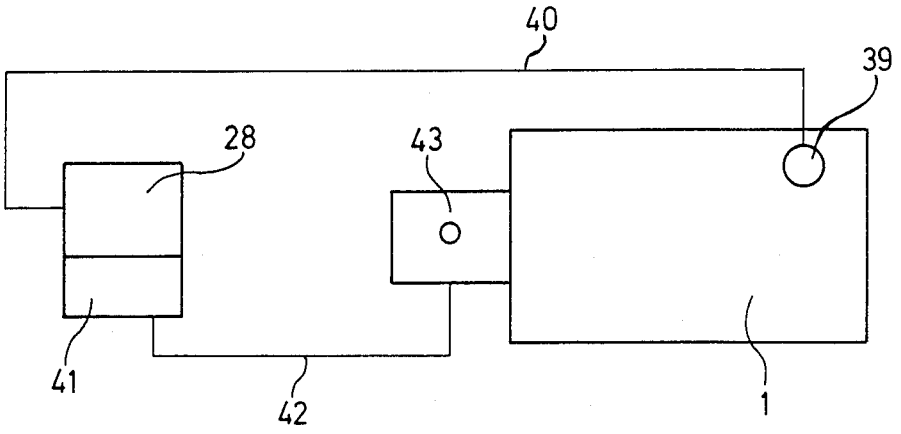
FIG. 5 is a diagrammatic view of an arrangement for regulating the switch-on period of a preheater.

In FIG. 5 a diagrammatic circuit arrangement is shown, which shows a means for achieving an energy-saving operation of nozzle holder preheater 43 in an illustrative example. In FIG. 5, heater 1 according to FIG. 1 is represented as a block, which carries the same reference numbers, and nozzle holder preheater 43 is represented in another block. Heater 1 contains a temperature sensor 39, which determines the temperature condition of the heater.

An output of temperature sensor 39 is applied to control device 28 by circuit 40. In control device 28 is provided a timing circuit 41, whose output is connected by circuit 42 to nozzle holder preheater 36.

With the help of this circuit arrangement, the switch-on period of nozzle holder preheater 43 can vary as a function of the temperature condition of heater 1 determined by temperature sensor 39. At a higher temperature of heater 1 or at higher ambient temperature, a shorter switch-on period of nozzle holder preheater 43 is sufficient, while in a cold condition of heater 1 a longer switch-on period of nozzle holder preheater 43 is advantageous. The switch-on period of nozzle holder preheater 43 can be varied either continuously or by steps by timing circuit 41. Preferably such a construction is provided that a minimum switch-on period is selected, which, for example, in the case of a temperature of −10 degrees C at temperature sensor 39 amounts to about 1 minute. In case of a temperature of 0 degrees C at temperature sensor 39 no preheating is required in most cases, so that nozzle holder preheater 36 remains cut off. In the case of a gradual change of the switch-on period of nozzle holder preheater 43, starting with the above indicated minimum switch-on period, the switch-on period is varied at lower temperatures so that an integral multiple of the minimum switch-on period is obtained. At −20 degrees C the switch-on period can amount to 2 minutes, for example, at −30 degrees C to 3 minutes and at −40 degrees C to 4 minutes.

Of course, for these changes of the switch-on period of nozzle holder preheater 43 also other temperature threshold values and/or other values for the minimum switch-on period can be chosen and specified.

Thanks to this controlled switch-on period of nozzle holder preheater 43, the power consumption of heater 1 can be reduced as much as possible, since the power for the operation of nozzle holder preheater 43 must be taken, for example, from a battery in the case of a vehicle heater. As a result, unnecessary discharges of the vehicle battery are avoided.

Of course, embodiments deviating from the represented embodiments are possible to the extent that the functioning parts of subassembly 30 are related to one another in another way, provided that they form an integrated subassembly 30 according to the invention. Similarly, the temperature-dependent adjustment of the switch-on period of nozzle holder preheater 43 can be achieved in a way other than represented and can take place, for example, continuously, without the basic concept according to the invention being abandoned. Also the fastening of subassembly 30 to flange 3 can take place, for example, continuously, without the basic concept according to the invention being abandoned. Also the fastening of subassembly 30 to flange 3 can take place in a way different from the one represented and, for example, a larger or smaller number of screws can be used, which essentially is dependent on the size of the subassembly thus formed and the existing space conditions. Other embodiments and modifications will be apparent to those of ordinary skill so that this invention should be viewed as encompassing everything within the scope of the appended claims.

We claim:

1. Fuel-operated vehicle heater having an atomizing burner, an atomizing nozzle carried by a nozzle holder, a fuel pump for delivering fuel to the atomizing nozzle via a filter and an interposed solenoid valve, and a combustion air blower driven by a drive motor, wherein the nozzle holder is in the form of a housing by way of which the heater components comprised of the atomizing nozzle, the fuel pump, the filter and the solenoid valve are combined into a unified subassembly carried by said nozzle holder as a single unit.

2. Vehicle heater according to claim 1 wherein said filter is installed in said subassembly in immediate proximity with said fuel pump.

3. Vehicle heater according to claim 1, wherein an ignition spark emitter is fastened to said subassembly.

4. Vehicle heater according to claim 1, wherein said subassembly is fastened to a flange of a housing of the heater.

5. Vehicle heater according to claim 4, wherein a fuel feed line leading to the fuel pump and a fuel return line are formed in said flange.

6. Vehicle heater according to claim 5, wherein a connection to the pump of at least one of the fuel feed line and the fuel return line occurs at an interface between the subassembly and the flange via an interposed seal.

7. Vehicle heater according to claim 3, wherein said subassembly and ignition spark emitter are connected to a central connecting device by which electrical power is supplied to the components of the subassembly, said central connecting device being provided with a control device and being fastened to a rear side of flange which faces away from the nozzle.

8. Vehicle heater according to claim 3, wherein the fuel pump, filter, solenoid valve and ignition spark emitter are positioned radially around the nozzle holder.

9. Vehicle heater according to claim 1, wherein the fuel pump and combustion air blower are driven directly by said drive motor.

10. Vehicle heater according to claim 9, wherein the drive motor is attached on said rear side of the flange.

11. Vehicle heater according to claim 1, wherein a preheater is fitted into a socket in the nozzle holder.

12. Vehicle heater according to claim 11, wherein a projection is formed on the nozzle holder with a through-hole serving as the socket in which the preheater is fitted.

13. Vehicle heater according to claim 11, wherein said preheater is a heating cartridge.

14. Vehicle heater according to claim 11, wherein said preheater is placed near said filter.

15. Vehicle heater according to claim 4, wherein the pump is connected to the flange and a seal is provided at the connection of the flange to the fuel pump.

16. Vehicle heater according to claim 15, wherein the seal is a O-ring.

17. Vehicle heater according to claim 1, wherein the solenoid valve adjoins the nozzle holder in proximity to the atomizing nozzle.

18. Vehicle heater according to claim 1, wherein said subassembly holds a flame monitor.

19. Vehicle heater according to claim 18, wherein the flame monitor is a phototransistor plugged into a socket opening in said subassembly.

* * * * *

UNITED STATES PATENT AND TRADEMARK OFFICE

CERTIFICATE OF CORRECTION

PATENT NO. : 4,718,602

DATED : January 12, 1988

INVENTOR(S) : Wolfgang Beck, Werner Lucius, Ernst Mosig, and Bernhard Umlauf

It is certified that error appears in the above-identified patent and that said Letters Patent are hereby corrected as shown below:

In item [30] on the face of the patent, "3626143" has been corrected to --3536143 --

Signed and Sealed this

Twenty-sixth Day of July, 1988

*Attest:*

DONALD J. QUIGG

*Attesting Officer*

*Commissioner of Patents and Trademarks*